US007001189B1

(12) United States Patent
McGowan et al.

(10) Patent No.: US 7,001,189 B1
(45) Date of Patent: Feb. 21, 2006

(54) BOARD MOUNTED POWER CONNECTOR

(75) Inventors: Daniel B. McGowan, Naperville, IL (US); Steven B. Bogiel, Lisle, IL (US); William P. Hendrickson, Yorkville, IL (US); Arvind Patel, Naperville, IL (US); Timothy E. Purkis, Naperville, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/981,295

(22) Filed: Nov. 4, 2004

(51) Int. Cl.
*H01R 12/00* (2006.01)

(52) U.S. Cl. ..... 439/79; 439/947

(58) Field of Classification Search ..... 439/947, 439/79, 80, 541.5

See application file for complete search history.

(56) References Cited

U.S. PATENT DOCUMENTS

| | | | | |
|---|---|---|---|---|
| 5,158,471 | A * | 10/1992 | Fedder et al. | 439/80 |
| 5,376,012 | A * | 12/1994 | Clark | 439/80 |
| 6,210,240 | B1 * | 4/2001 | Comerci et al. | 439/853 |
| 6,241,564 | B1 | 6/2001 | Chen et al. | 439/885 |
| 6,280,245 | B1 * | 8/2001 | Han | 439/541.5 |
| 6,299,492 | B1 | 10/2001 | Pierini et al. | 439/884 |
| 6,319,075 | B1 | 11/2001 | Clark et al. | 439/825 |
| 6,402,566 | B1 | 6/2002 | Middlehurst et al. | 439/699.1 |
| 6,471,523 | B1 | 10/2002 | Shuey | 439/63 |
| 6,604,967 | B1 | 8/2003 | Middlehurst et al. | 439/862 |
| 6,672,884 | B1 | 1/2004 | Toh et al. | 439/79 |
| 6,776,635 | B1 | 8/2004 | Blanchfield et al. | 439/181 |
| 6,869,294 | B1 * | 3/2005 | Clark et al. | 439/79 |

* cited by examiner

*Primary Examiner*—Phuong Dinh
(74) *Attorney, Agent, or Firm*—Stephen Z. Weiss

(57) ABSTRACT

An electrical power connector is mountable on a printed circuit board. The connector includes an outer terminal and an inner terminal, both of which are of generally inverted U-shaped configurations, with the inner terminal nested in the outer terminal. Solder tails project downwardly from bottom edges of side walls of the two terminals. Both terminals have a pair of blade portions projecting forwardly from the respective side walls of the terminals, whereby the blade portions of each terminal are spaced from each other. The blade portions of one terminal are generally coplanar with the blade portions of the other terminal. A dielectric housing is overmolded about the side walls of the outer terminal, leaving the solder tails and the outside surfaces of the blade portions exposed. The housing has a projecting portion extending into the spacing between the blade portions of the two terminals against the inside surfaces of the blade portions, leaving the outside surfaces of the blade portions exposed.

8 Claims, 3 Drawing Sheets

BOARD MOUNTED POWER CONNECTOR

FIELD OF THE INVENTION

This invention generally relates to the art of electrical connector and, particularly, to a power connector and, still further, to a power connector for mounting on a printed circuit board.

BACKGROUND OF THE INVENTION

Generally, an electrical connector includes some form of dielectric or insulative housing which mounts one or more conductive terminals. The housing is configured for mating with a complementary mating connector or other connecting device which, itself, has one or more conductive terminals. A connector assembly typically includes a pair of mating connectors, such as plug and receptacle connectors sometimes called male and female connectors.

Various types of electrical connectors are designed for mounting on a printed circuit board. The terminals have terminating ends for connection to appropriate circuit traces on the board, such as solder tails for solder connection to the circuit traces on the board and/or in holes in the board.

One type of board mounted connector is a power (i.e., versus a signal) connector which mounts one or more power terminals. The power connector couples power circuitry to or from power circuits on the printed circuit board. With the ever-increasing density of electrical components used in electronic packaging, electrical power connectors often are needed to carry high current between a circuit board and a complementary mating connector or other connecting device, or between one circuit board and another circuit board. Power connectors typically are rather robust structures, and a male power connector may include one or more rather sizable terminal blades.

As microprocessor voltages decrease, current requirements have increased, leading to the need for power connectors with low contact resistance to minimize voltage drop. While the current demand increases, design demands are presented for power connectors of ever-decreasing sizes. This creates a myriad of problems.

There is a need for a board mounted power connector which meets both the contact resistance requirements as well as the size constraints. The present invention is directed to solving these problems and satisfying such needs.

SUMMARY OF THE INVENTION

An object, therefore, of the invention is to provide a new and improved electrical power connector of the character described, particularly a power connector mountable on a printed circuit board.

In the exemplary embodiment of the invention, the power connector includes an outer terminal of a generally inverted U-shape. The outer terminal includes a pair of side walls joined by a top connecting beam The side walls include upper sections and lower sections. A plurality of solder tails project downwardly along a bottom edge of the lower section of each side wall. A blade portion projects forwardly from an edge of the upper section in a direction generally parallel to the circuit board, whereby the blade portions are spaced from each other.

An inner terminal of a generally inverted U-shape is nested in the outer terminal between the lower sections of the side walls thereof. The inner terminal includes a pair of side walls joined by a top connecting beam. A plurality of solder tails project downwardly along a bottom edge of the side walls. A blade portion projects forwardly from an edge of each side wall in a spaced relationship and in a direction generally parallel to the circuit board beneath and generally coplanar with the respective blade portions of the outer terminal.

A dielectric housing is overmolded about the side walls of the outer and inner terminals, leaving the solder tails and the outside surfaces of the blade portions exposed. The housing has a projecting portion extending into the spacing between the respective blade portions of the two terminals against the inside surfaces of the blade portions.

According to one aspect of the invention, the overmolded housing is disposed between the upper sections of the side walls of the outer terminal and between the side walls of the inner terminal. On the other hand, the side walls of the inner terminal are in engagement with the lower sections of the side walls of the outer terminal.

According to another aspect of the invention, the housing includes a projecting shroud around and spaced from the blade portions of the terminals. The shroud is open for receiving a mating connecting device. The shroud is generally rectangular and includes integral reinforcing ribs in the inside corners thereof.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
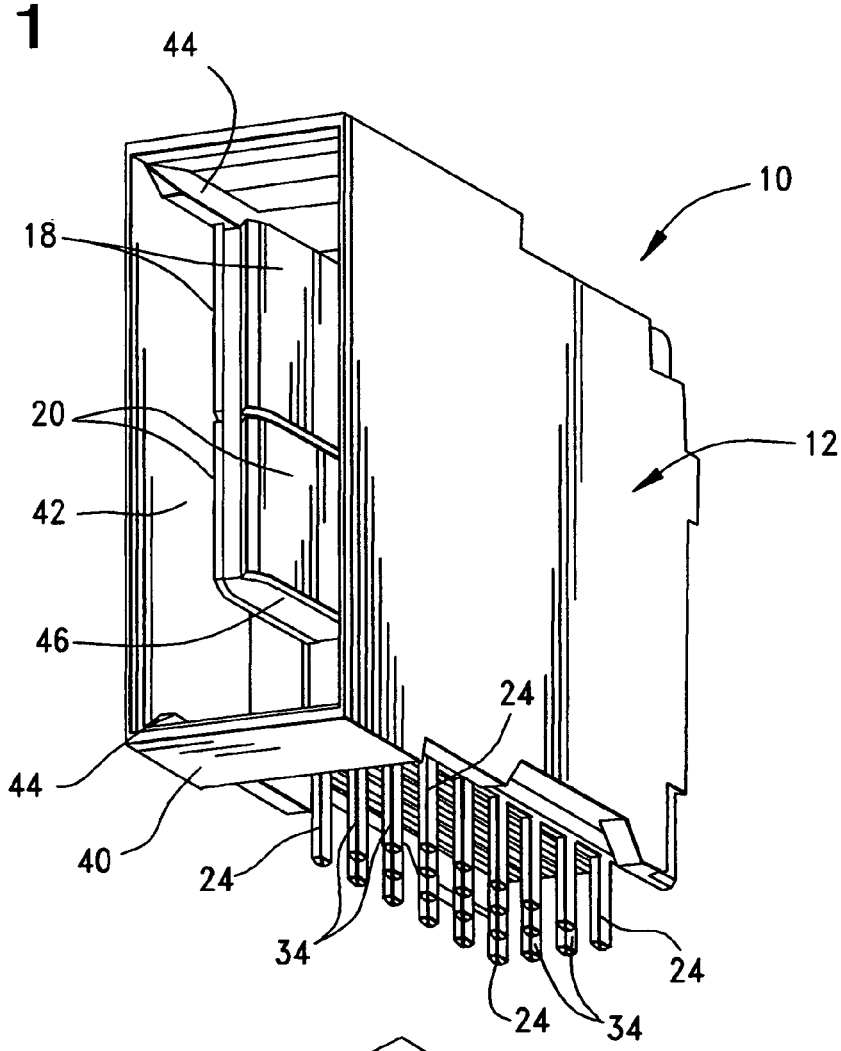
FIG. 1 is a bottom, front perspective view of an electrical power connector embodying the concepts of the invention.
Figure 2:
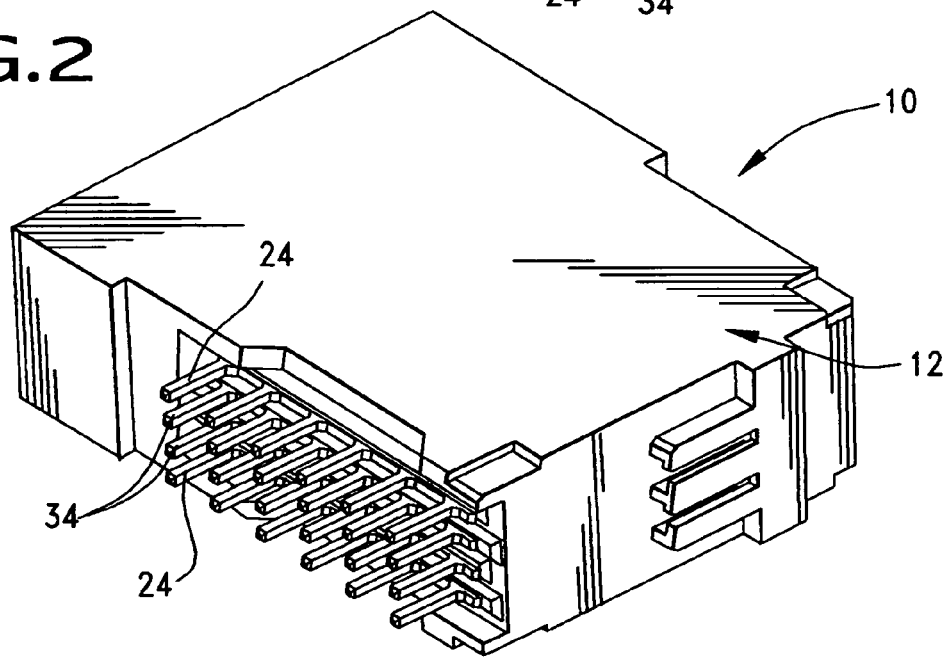
FIG. 2 is a bottom, rear perspective view of the connector.
Figure 3:
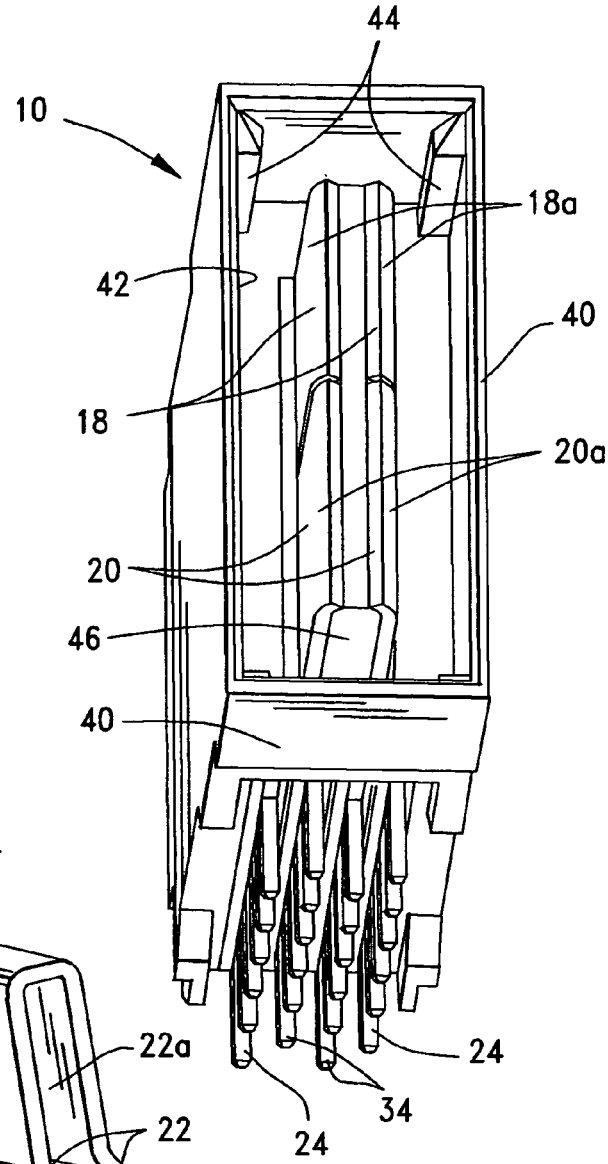
FIG. 3 is a bottom, front perspective view at a different angle from that of FIG. 1.

Referring to the drawings in greater detail, the invention is embodied in an electrical power connector, generally designated 10 and shown in FIGS. 1–3. The connector is extremely simple and includes a unitary, overmolded housing, generally designated 12, and outer and inner terminals, generally designated 14 and 16, respectively, in FIG. 4. Outer terminal 14 has a pair of blade portions 18, and inner terminal 16 has a pair of blade portions 20. The blade portions of one terminal are coplanar with the blade portions of the other terminal, and the two blade portions of each terminal are in spaced relationship as can be seen particularly in FIG. 3.

Figure 4:
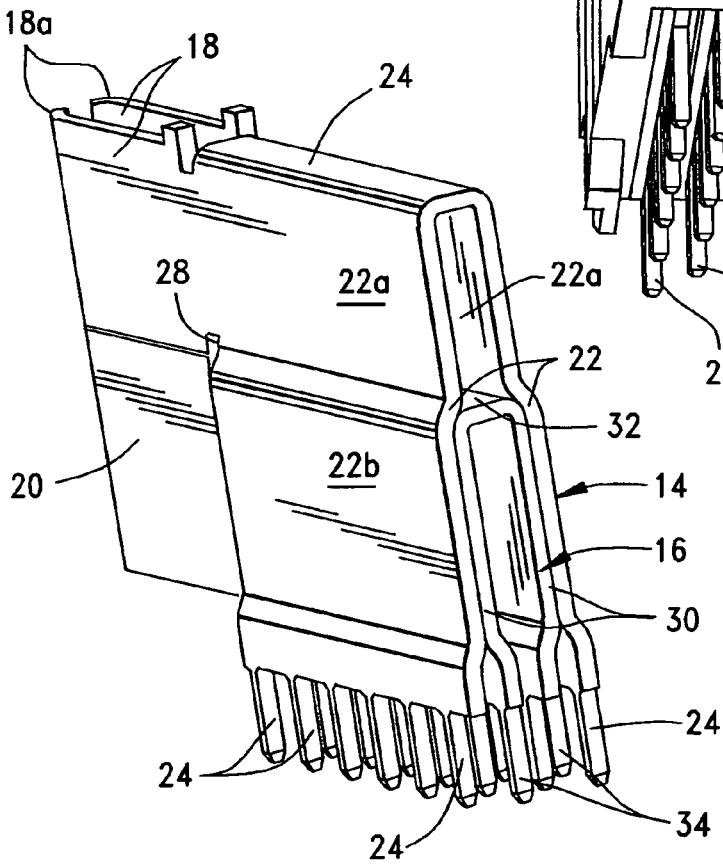
FIG. 4 is a rear perspective view of the two terminals of the connector in nested condition as they would be within the connector.
Figure 5:
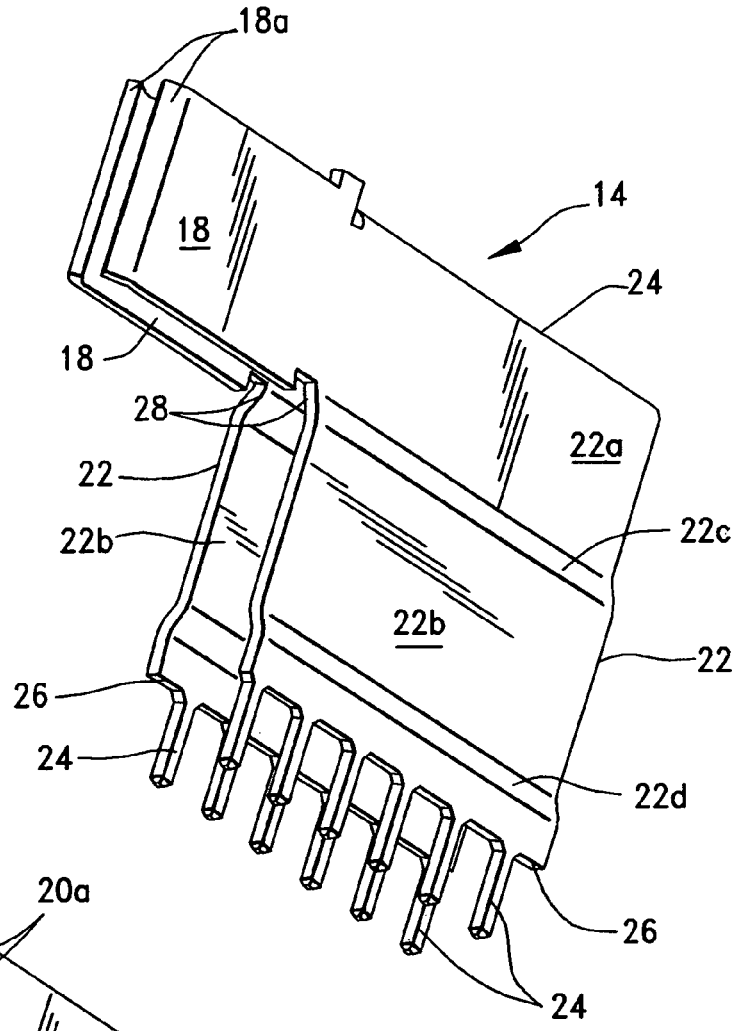
FIG. 5 is a perspective view of the outer terminal.

Referring to FIG. 5 in conjunction with FIG. 4, outer terminal 14 has a generally inverted U-shaped configuration. The outer terminal includes a pair of side walls 22 joined by a top connecting beam 24. Side walls 22 include upper sections 22*a* and lower sections 22*b*. A plurality of solder tails 24 project downwardly along a bottom edge 26 of lower section 22*b* of each side wall to form two rows of solder tails. Blade portions 18 project forwardly from edges 28 of upper sections 22*a* of side walls 22 generally parallel to a printed circuit board (not shown) on which the connector is mounted. Like the side walls (i.e., upper sections 22*a*), blade portions 18 are spaced from each other. The outer terminal may be stamped and formed of sheet metal material, and lower sections 22*b* are spaced outwardly from upper sections 22*a* by upper bent sections 22*c* of side walls 22 in order to receive inner terminal 16 as seen in FIG. 4. In addition, lower bent sections 22*d* spread the two rows of solder tails 24 further apart to space the rows of solder tails from the rows of solder tails of inner terminal 16, as described hereinafter. Finally, the forward distal ends or edges 18*a* of blade portions 18 are bent inwardly to form curved outer surfaces for engaging a female terminal or terminals of a complementary connector or other connecting device.

Figure 6:
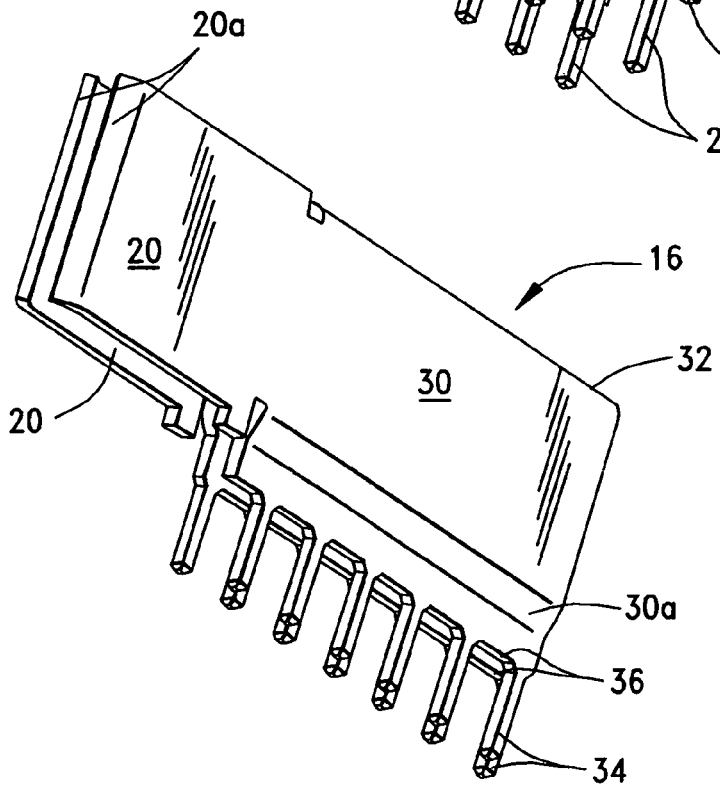
FIG. 6 is a perspective view of the inner terminal.

Referring to FIG. 6 in conjunction with FIG. 4, inner terminal 16 also is of a generally inverted U-shape and is nested in outer terminal 14 as seen in FIG. 4. Specifically, the inner terminal is nested within lower sections 22*b* of side walls 22 of the outer terminal. The inner terminal includes a pair of side walls 30 joined by a top connecting beam 32. A plurality of solder tails 34 project downwardly along bottom edges 36 of side walls 30 to form two rows of solder tails. Bent sections 30*a* of side walls 30 space the two rows of solder tails closer to each other than the spacing between side walls 30. The result of this closer spacing is shown clearly in FIG. 4, wherein it can be seen that there is a generally equal spacing between all four rows of solder tails provided by the two terminals. Blade portions 20 project forwardly from side walls 30 in a spaced relationship and in a direction generally parallel to blade portions 18 (i.e., generally parallel to the circuit board). In fact, blade portions 20 of inner terminal 16 are generally coplanar with blade portions 18 of outer terminal 14. Like blade portions 18, blade portions 20 have inwardly bent distal ends or edges 20*a* in order to provide rounded outer surfaces for engaging the female terminal or terminals of the mating connector or other connecting device.

Housing 12 is a substantially encompassing structure which is molded of dielectric plastic material and is overmolded about outer and inner terminals 14 and 16, respectively, when the terminals are nested as shown in FIG. 4. The housing surrounds side walls 22 and connecting beam 24 of outer terminal 14, leaving solder tails 24 and the outside surfaces of blade portions 18 exposed. The housing is overmolded within upper sections 22*a* of side walls 22 of outer terminal 14, as well as within side walls 30 of inner terminal 16. On the other hand, side walls 30 of the inner terminal are maintained in engagement with lower sections 22*b* of the side walls of the outer terminal, as is clearly shown in FIG. 4. The housing is molded with a projecting shroud 40 which is spaced outwardly from blade portions 18 and 20 of the inner and outer terminals 14 and 16, respectively. The shroud projects at least slightly beyond distal ends 18*a* and 20*a* of the blade portions to protect the blade portions. The shroud is open to define a receptacle 42 for receiving the mating connector or other connecting device. The receptacle is generally rectangular in configuration and includes integral reinforcing ribs 44 at the inside corners of the shroud.

An advantageous feature of the invention is that overmolded housing 12 includes a plug portion (FIGS. 1 and 3) which is over molded into the spaces between blade portions 18 and 20 of the outer and inner terminals, respectively, and into engagement with the inside surfaces of the blade portions. This overmolded plug portion has a number of advantages. First, the outside surfaces of the blade portions can be gold plated while not providing plating on the inside surfaces thereof. Second, the sheet metal material from which the terminals are stamped and formed can be thinner than is normally contemplated because plug portion 46 supports blade portions 18 and 20, and the entire remainder of the outer and inner terminals are surrounded and supported by dielectric plastic material, except for tail portions 24 and 34 which are inserted into and supported by holes in the printed circuit board. The thinner material saves costs in fabricating the overall connector. Still further, the thinner metal material allows for smaller and less expensive stamping and forming machines than typically are required to stamp and form power terminals.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical power connector mountable on a printed circuit board, comprising:

an outer terminal of a generally inverted U-shape and including a pair of side walls joined by a top connecting beam, the side walls including upper sections and lower sections, a plurality of solder tails projecting downwardly along a bottom edge of the lower section of each side wall, and a blade portion projecting forwardly from an edge of the upper section of each side wall in a direction generally parallel to the circuit board whereby the blade portions are spaced from each other;

an inner terminal of a generally inverted U-shape and nested in the outer terminal between the lower sections of the side walls thereof, the inner terminal including a pair of side walls joined by a top connecting beam, a plurality of solder tails projecting downwardly along a bottom edge of the side walls, and a blade portion projecting forwardly from an edge of each side wall in a spaced relationship and in a direction generally parallel to the circuit board beneath and generally coplanar with the respective blade portions of the outer terminal; and a dielectric housing overmolded about the side walls of the outer and inner terminals leaving the solder tails and the outside surfaces of the blade portions exposed, the housing having a projecting portion extending into the spacing between the respective blade portions of the two terminals against the inside surfaces of the blade portions.

2. The electrical power connector of claim 1 wherein said overmolded housing is disposed between the upper sections of the side walls of the outer terminal and between the side walls of the inner terminal.

3. The electrical power connector of claim 1 wherein the side walls of the inner terminal are in engagement with the lower sections of the side walls of the outer terminal.

4. The electrical power connector of claim 1 wherein said housing includes a projecting shroud around and spaced from the blade portions of the terminals, the shroud being open to define a receptacle for receiving a mating connecting device.

5. The electrical power connector of claim 4 wherein said shroud is generally rectangular and includes integral reinforcing ribs in the inside corners thereof.

6. The electrical power connector of claim 1 wherein the blade portions of the inner terminal are generally coplanar with the blade portions of the outer terminal.

7. An electrical power connector mountable on a printed circuit board, comprising:

a dielectric housing;

an outer terminal of a generally inverted U-shape mounted on the housing and including a pair of side walls joined by a top connecting beam, the side walls including upper sections and lower sections, a plurality of solder tails projecting downwardly along a bottom edge of the lower section of each side wall, and a blade portion projecting forwardly from an edge of the upper section of each side wall in a direction generally parallel to the circuit board whereby the blade portions are spaced from each other; and an inner terminal of a generally inverted U-shape mounted on the housing and nested in the outer terminal between the lower sections of the side walls thereof, the inner terminal including a pair of side walls joined by a top connecting beam, a plurality of solder tails projecting downwardly along a bottom edge of the side walls, and a blade portion projecting forwardly from an edge of each side wall in a spaced relationship and in a direction generally parallel to the circuit board beneath and generally coplanar with the respective blade portions of the outer terminal.

8. The electrical power connector of claim 7 wherein the side walls of the inner terminal are in engagement with the lower sections of the side walls of the outer terminal.

* * * * *